US008171664B2

(12) United States Patent
Buncher

(10) Patent No.: US 8,171,664 B2
(45) Date of Patent: May 8, 2012

(54) CONFIGURABLE COMPUTER DISPLAY STAND BEARING SIGNAGE WITH A USER-SELECTED ONE OF MULTIPLE ORIENTATIONS TO PHYSICALLY CONFORM TO POINT OF SALE PHYSICAL CONSTRAINTS

(75) Inventor: Jan Buncher, San Diego, CA (US)

(73) Assignee: Sony Corporation, Tokyo (JP)

( * ) Notice: Subject to any disclaimer, the term of this patent is extended or adjusted under 35 U.S.C. 154(b) by 249 days.

(21) Appl. No.: 12/709,894

(22) Filed: Feb. 22, 2010

(65) Prior Publication Data

US 2011/0203150 A1 Aug. 25, 2011

(51) Int. Cl.

| | |
|---|---|
| ***G09F 3/18*** | (2006.01) |
| ***G09F 3/20*** | (2006.01) |
| ***G09F 15/02*** | (2006.01) |
| ***G09F 15/00*** | (2006.01) |
| ***G09F 7/00*** | (2006.01) |

(52) U.S. Cl. ..... 40/661.08; 40/649; 40/658; 40/606.16; 40/612; 248/488; 248/229.16; 248/918; 248/460; 248/346.07; 248/346.3; 248/346.01; 248/917; 248/122.1; 248/124.1; 248/220.22; 248/295.11; 361/679.01

(58) Field of Classification Search ..... 40/661.08, 40/649, 658, 606.19, 606.16, 612; 248/488, 248/229.16, 918, 460, 346.07, 364.3, 346.01, 917, 122.1, 124.1, 128.8, 220.22, 295.11, 298.14; 361/679

See application file for complete search history.

(56) References Cited

U.S. PATENT DOCUMENTS

| | | | | | |
|---|---|---|---|---|---|
| 1,322,188 | A | * | 11/1919 | Henry | 40/649 |
| 1,471,334 | A | * | 10/1923 | Hopper | 40/745 |
| 2,161,193 | A | * | 6/1939 | Phillips | 40/618 |
| 4,176,485 | A | * | 12/1979 | Terris | 40/584 |
| 5,706,597 | A | * | 1/1998 | Brandstetter | 40/611.13 |

* cited by examiner

*Primary Examiner* — Joanne Silbermann
*Assistant Examiner* — Syed A Islam
(74) *Attorney, Agent, or Firm* — John L. Rogitz

(57) ABSTRACT

A display stand for a laptop computer has an L-shaped spine supporting the computer. A T-shaped upper advertising substrate holder can be slid into the vertical leg of the spine in one of multiple orientations, i.e., with the cross-bar of the T horizontal to the ground or vertical to the ground on either the left side or right side of the computer, as point of sale (POS) physical constraints demand. In all orientations of the upper holder, an upper advertising substrate is supported by the upper holder in a vertical orientation. A T-shaped lower advertising substrate holder can be slid into the horizontal leg of the spine to support a lower advertising substrate in a horizontal orientation.

13 Claims, 6 Drawing Sheets

CONFIGURABLE COMPUTER DISPLAY STAND BEARING SIGNAGE WITH A USER-SELECTED ONE OF MULTIPLE ORIENTATIONS TO PHYSICALLY CONFORM TO POINT OF SALE PHYSICAL CONSTRAINTS

I. FIELD OF THE INVENTION

The present application is directed to configurable computer display stands that bear advertising signage with a user-selected one of multiple orientations to physically conform to point of sale physical constraints.

II. BACKGROUND OF THE INVENTION

It is not uncommon for retail outlets to place advertising information next to consumer electronics (CE) products (such as laptop computers) on display, to better inform prospective purchasers of the advantages of the vended products. As understood herein, it is preferable that such advertising information be presented in an appealing, effective way that clearly indicates the physical product being sold, while conforming to point of sale (POS) physical constraints. As understood herein, such constraints can vary store to store and thus render a "one size fits all" solution too inflexible.

SUMMARY OF THE INVENTION

Accordingly, a display assembly includes an L-shaped spine which in turn includes a flat rectangular horizontal leg and attached to an end of or made integrally with the horizontal leg, a flat rectangular vertical leg. The legs are perpendicular to each other. A respective L-shaped flange borders a respective long edge of each leg to form, with the respective leg, a respective U-shaped channel. Additionally, a flat T-shaped lower advertising substrate holder can be slidably engaged with the U-shaped grooves of the horizontal leg. The lower holder includes a rectangular stalk the edges of which are slidably received in the U-shaped channels of the horizontal leg and, perpendicular, to the stalk a rectangular substrate-holding cross-member. L-shaped flanges border long edges of the cross-member for forming, with the cross-member, U-shaped channels configured for slidably receiving a flat rectangular printed substrate. An interference fit is established between the lower holder and the horizontal leg such that the lower holder can be slid as far or as little relative to the horizontal leg as desired to account for point of sale (POS) constraints.

Furthermore, the assembly includes a flat T-shaped upper advertising substrate holder which includes a rear member that can be slid into the U-shaped channels of the vertical leg of the spine in a user-desired one of multiple orientations. The upper holder also includes a rectangular stalk and, perpendicular to the stalk, a rectangular substrate-holding cross-member. L-shaped flanges border long edges of the cross-member for forming, with the cross-member, U-shaped channels that slidably receive a flat rectangular printed substrate. An interference fit is established between the upper holder and vertical leg such that the upper holder can be slid as far or as little relative to the vertical leg as desired to account for POS constraints. The cross-member of the upper holder can be oriented with its long edges parallel to the horizontal and then engaged with the vertical leg with its long edges parallel to the horizontal. Also, the cross-member of the upper holder can be oriented with the long edges of the cross-member perpendicular to the horizontal on a user-selected side of the horizontal leg of the spine and then engaged with the vertical leg with its long edges perpendicular to the horizontal.

In some example embodiments a CE device is juxtaposed with the horizontal leg, an upper flat, rectangular printed advertising substrate is supported by the upper holder, and a lower flat, rectangular printed advertising substrate is supported by the lower holder.

In some implementations the rear member is established at least in part by a square sliding member. Edges of the stalk of the upper holder can extend slightly beyond edges of the square sliding member. Air-filled gaps are established along all four edges of the sliding member between the stalk and a square surface of the sliding member facing the stalk. With this structure, the upper holder can be slidably engaged with the vertical leg of the spine by sliding the stalk of the upper holder against the vertical leg with the sliding member slidably disposed in the grooves formed by L-shaped flanges of the vertical leg of the spine. Lips of the L-shaped flanges of the vertical leg trap the sliding member in the U-shaped groove, with the front surface of the stalk overlapping the front surfaces of the lips.

In another aspect, a display stand for a laptop computer includes an L-shaped spine and a T-shaped upper advertising substrate holder slidably engaged with a vertical leg of the spine in a user-determined one of multiple orientations. For example, a first orientation can be a cross-member of the upper holder oriented horizontal to the ground, while a second orientation can be the cross-member of the upper holder oriented vertical to the ground. An upper advertising substrate is supported by the upper holder. Also, a T-shaped lower advertising substrate holder is slidably engaged with a horizontal leg of the spine to support a lower advertising substrate in a horizontal orientation.

In another aspect, a method includes engaging an upper substrate holder with a support with a variable orientation being established between the upper holder and support as desired to conform to physical constraints of a point of sale (POS). The method also includes juxtaposing the support with a consumer electronics (CE) device sought to be vended, and engaging a printed advertising substrate with the upper substrate holder to permit a prospective buyer of the CE device to view the substrate in combination with the CE device.

The details of the present invention, both as to its structure and operation, can best be understood in reference to the accompanying drawings, in which like reference numerals refer to like parts, and in which:

DETAILED DESCRIPTION OF THE PREFERRED EMBODIMENT

Figure 1:
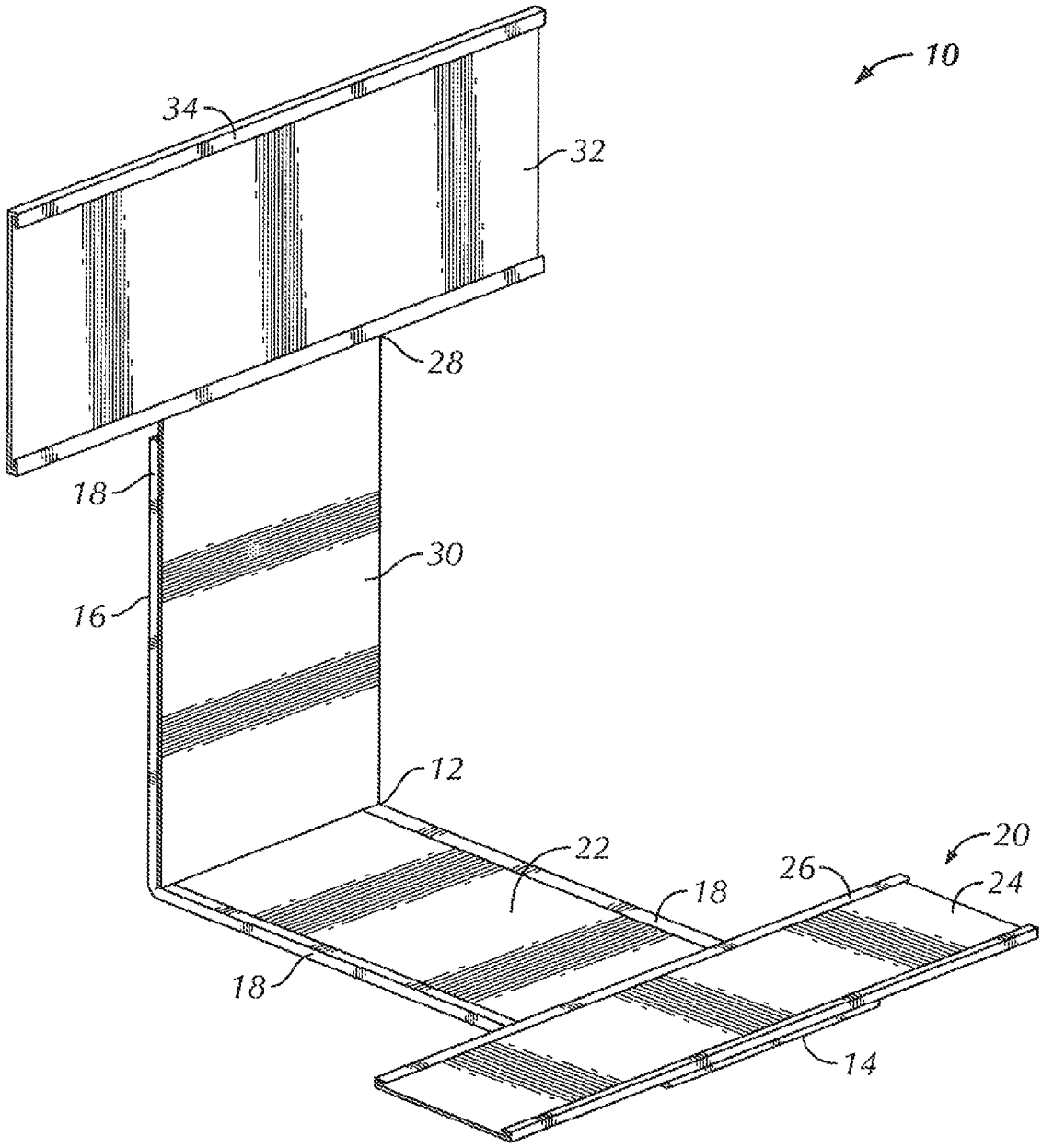
FIG. 1 is a perspective view of an example embodiment of the display stand.

Referring initially to FIG. 1, a consumer electronics (CE) device stand is shown, generally designated 10. The stand 10 may be made of lightweight metal or plastic and includes an L-shaped spine 12 supporting the CE device. The spine 12 includes a flat rectangular horizontal leg 14 and attached to an end of or made integrally with the horizontal leg 14, a flat rectangular vertical leg 16 which can be perpendicular to the horizontal leg 14. As shown in FIG. 1, an L-shaped flange 18 borders each respective long edge of the legs 14, 16 to form, with the respective leg 14, 16, a respective U-shaped channel that slidably receives structure to be shortly disclosed.

As shown in FIG. 1, a flat T-shaped lower advertising substrate holder 20 can be slid into the U-shaped grooves of the horizontal leg 14 of the spine 12 to support a lower advertising substrate in a horizontal orientation. In the example shown, the lower holder 20 includes a rectangular stalk 22 the edges of which are slidably received in the U-shaped channels of the horizontal leg 14 and perpendicular to the stalk 22, a rectangular substrate-holding cross-member 24. L-shaped flanges 26 border the long edges of the cross-member 24 as shown for forming, with the cross-member 24, U-shaped channels that slidably receive a flat rectangular printed substrate. Owing to the interference fit between the lower holder 20 and the horizontal leg 14, the lower holder 20 can be slid as far or as little relative to the horizontal leg 14 as desired to account for point of sale (POS) constraints and CE device configuration, i.e., the lower holder 20 can be slid into a relatively compact configuration or slid in to the horizontal leg 14 only a short distance to be relatively extended relative to the spine 12. When a person releases the lower holder 20 it stops sliding relative to the horizontal leg 14 and remains in position because of the interference fit. In some case the lower holder 20 may be omitted entirely if space and configuration demands require it.

Still referring to FIG. 1, a T-shaped upper advertising substrate holder 28 can include a rear member, disclosed further below, that can be slid into the U-shaped channels of the vertical leg 16 of the spine 12 in one of multiple orientations. FIG. 1 shows one such orientation, with additional orientations shown in figures discussed further below. The upper holder 28 includes a rectangular stalk 30 and perpendicular to the stalk 30, a rectangular substrate-holding cross-member 32. L-shaped flanges 34 border the long edges of the cross-member 32 as shown for forming, with the cross-member 32, U-shaped channels that slidably receive a flat rectangular printed substrate.

Owing to the interference fit between the upper holder 28 and vertical leg 16, the upper holder 28 can be slid as far or as little relative to the vertical leg 16 as desired to account for POS constraints and CE device configuration, i.e., the upper holder 28 can be slid into a relatively compact configuration or slid in to the vertical leg 16 only a short distance to be relatively extended relative to the spine 12. In some case the upper holder 28 may be omitted entirely if space and configuration demands require it.

In the orientation shown in FIG. 1, the cross-member 32 is oriented with its long edges parallel to the horizontal (as exemplified by the horizontal leg 14 of the spine 12). In other orientations described further below, the long edges of the cross-member 32 may be oriented perpendicular to the horizontal (as exemplified by the horizontal leg 14 of the spine 12) on either the left side or the right side of the horizontal leg 14 of the spine 12, as desired by retail personnel to conform to POS physical constraint demands. In all orientations of the upper holder 28, an upper advertising substrate is supported by the upper holder with the plane of the substrate vertical with respect to the horizontal.

Figure 2:
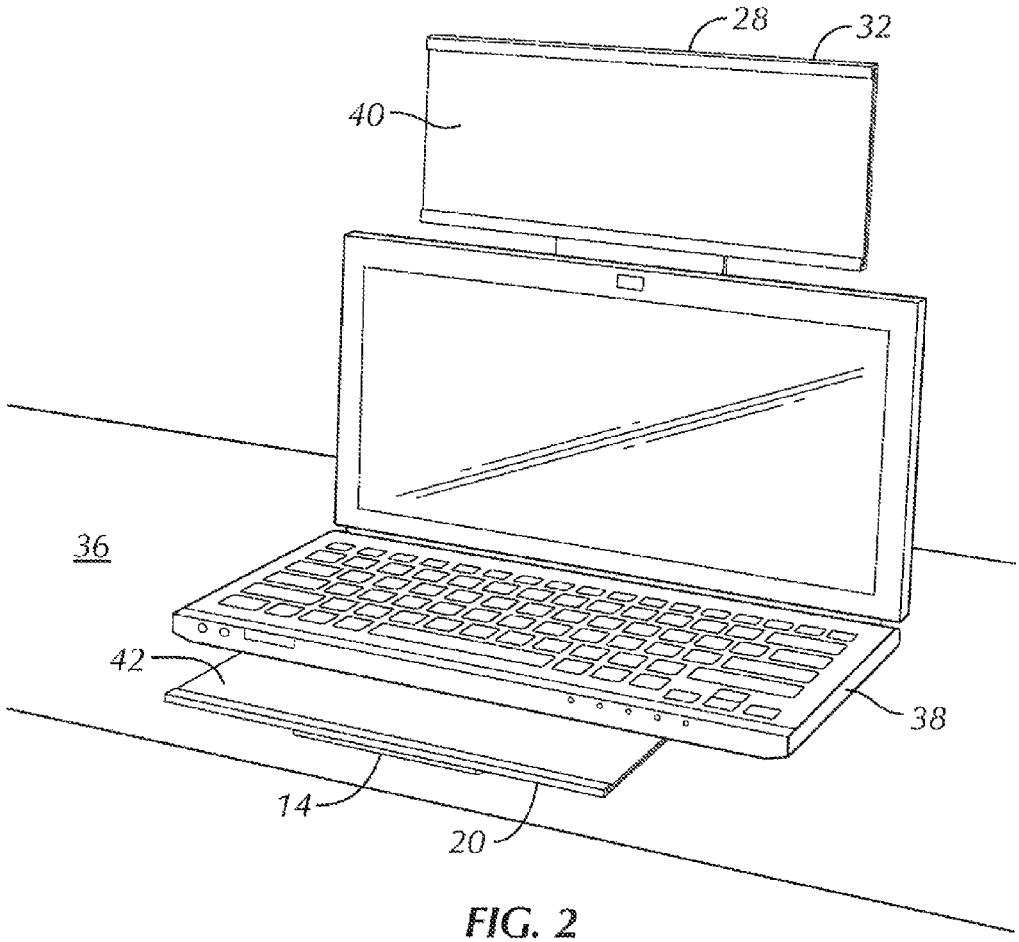
FIG. 2 is a perspective view of the display stand shown in FIG. 1 with advertising substrates engaged with the upper and lower substrate holders and a laptop computer supported on the spine of the stand.

FIG. 2 shows that with the horizontal leg 14 of the spine 12 resting on a horizontal display shelf 36 in, e.g., a retail outlet, a CE device 38 such as the laptop computer shown may be disposed on the horizontal leg 14 with the screen portion of the laptop against the vertical leg of the spine 12. An upper flat, rectangular, typically cardboard printed advertising substrate 40 is supported by the upper holder 28. The substrate 40 simply is slid within the above-described U-shaped channels of the cross-member 32 of the upper holder 28 to the position shown in FIG. 2. It will readily be appreciated that the dimensions of the substrate 40 approximate the dimensions of the cross-member 32.

Similarly, a lower flat, rectangular, typically cardboard printed advertising substrate 42 is supported by the lower holder 20. The substrate 42 simply is slid within the above-described U-shaped channels of the cross-member 24 of the lower holder 20 to the position shown in FIG. 2. It will readily be appreciated that the dimensions of the lower substrate 42 approximate the dimensions of the lower cross-member 24.

Figure 3:
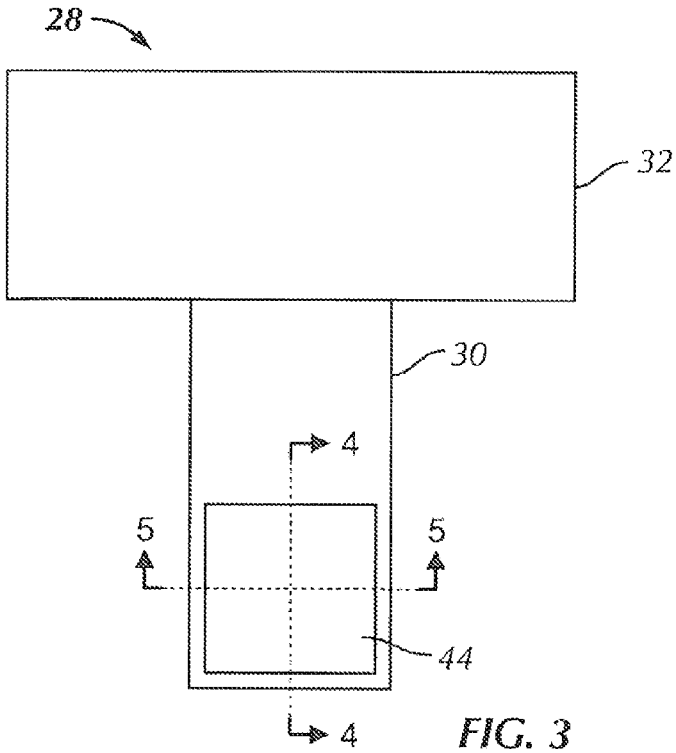
FIG. 3 is a rear elevational view of the upper advertising substrate holder.
Figure 4:
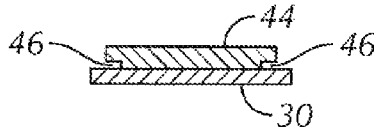
FIG. 4 is a cross-sectional view as seen along the line 4-4 in FIG. 3.
Figure 5:
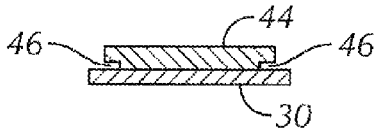
FIG. 5 is a cross-sectional view as seen along the line 5-5 in FIG. 3.

Now referring to FIGS. 3-5, example structure for enabling the upper holder 28 to be engaged with the spine 12 in multiple orientations as POS physical constraints dictate is shown. In the embodiment shown, the rear (relative to how a person typically views the stand 10 in a store) surface of the stalk 30 is attached to or formed integrally with a square sliding member 44. Looking at the elevational view of FIG. 3, as shown the edges of the stalk 30 may extend slightly beyond the edges of the square sliding member 44. In any case, as best shown in FIGS. 4 and 5 (which appear identical because of the square geometry of the sliding member 44), air-filled gaps 46 are established along all four edges of the sliding member 44 between the stalk 30 and the square surface of the sliding member 44 that faces the stalk 30.

It may now be appreciated that with this structure, the upper holder 28 can be slidably engaged with the vertical leg 16 of the spine 12 as follows. The stalk 30 of the upper holder 28 can be slid against the vertical leg 16 with the sliding member 44 slidably disposed in the grooves formed by L-shaped flanges 18 of the vertical leg 16 of the spine 12. The lips of the L-shaped flanges 18 of the vertical leg 16 trap the sliding member 44 in the U-shaped groove, with the front surface of the stalk 30 overlapping the front surfaces of the lips as can best be appreciated in reference to FIG. 1.

Figure 6:
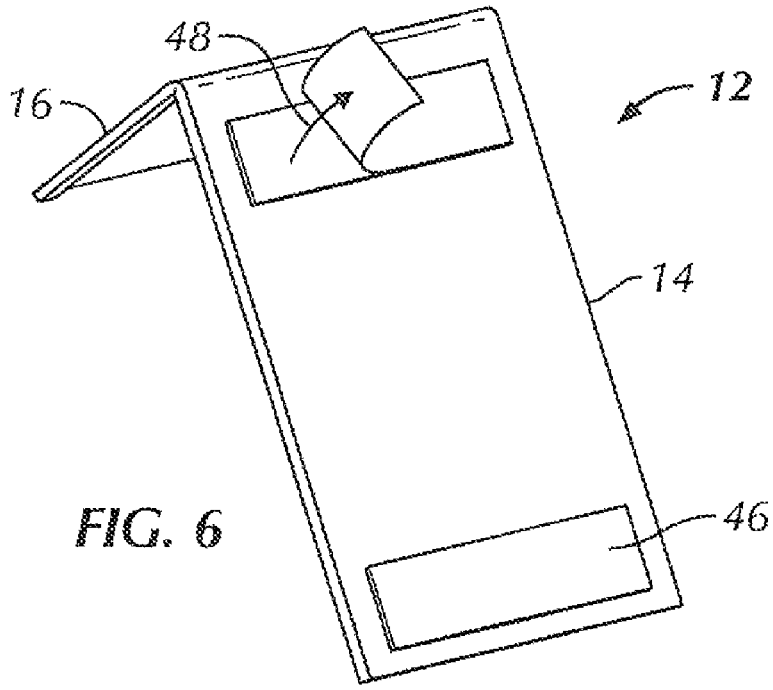
FIG. 6 is a perspective view of the rear of the spine, showing double back tape.
Figure 7:
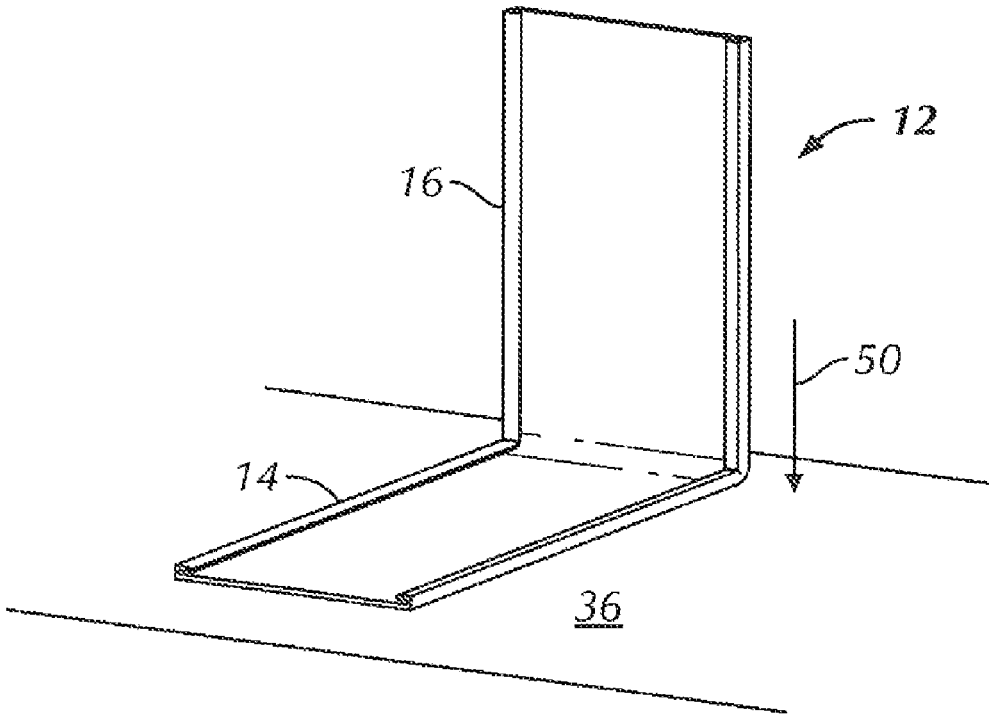
FIG. 7 is a perspective view showing the spine being pressed against a shelf.
Figure 8:
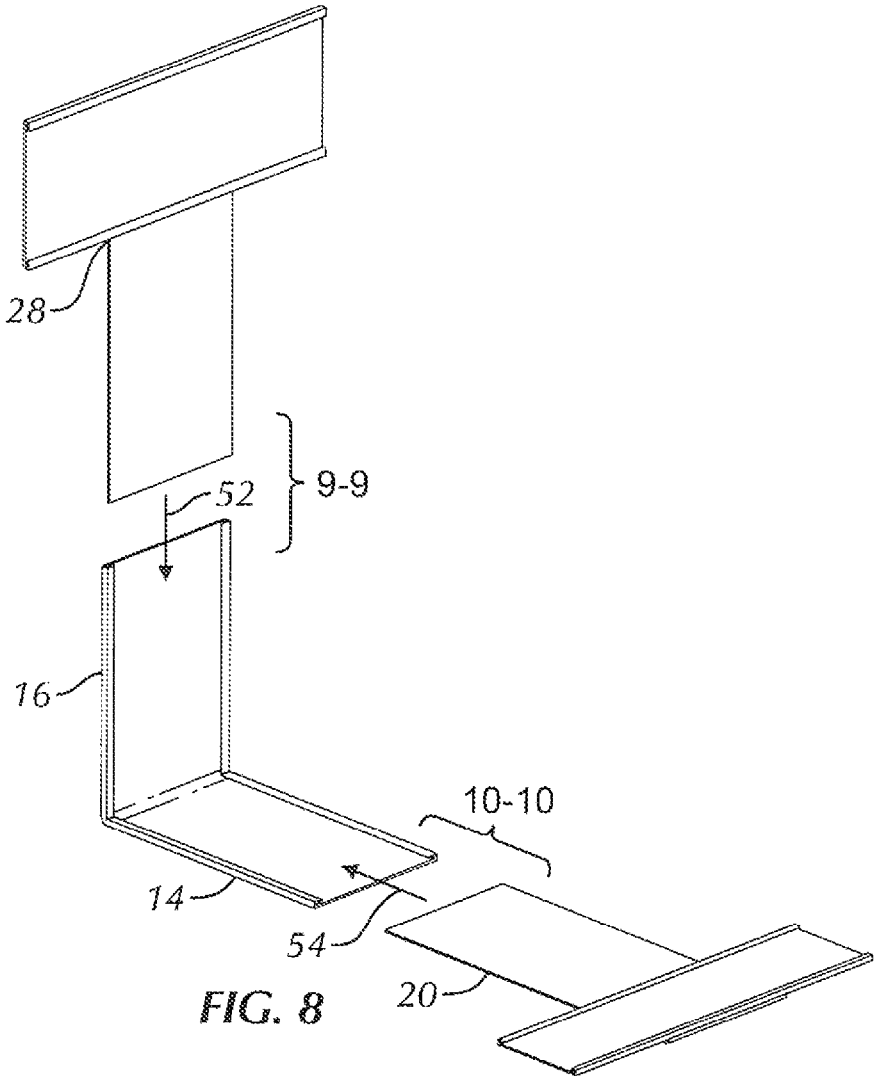
FIG. 8 is an exploded perspective view of the spine with upper and lower holders, with the upper holder in a "top" orientation.
Figure 9:
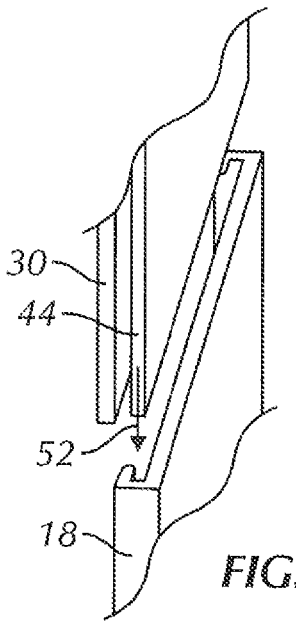
FIG. 9 is a detail view as seen in the block 9-9 in FIG. 8.

Before describing the various orientations of the upper holder 28, referring briefly to FIGS. 6 and 7, one or more strips 46 of double-backed tape can be adhered to the bottom surface of the horizontal member 14 of the spine 12. As indicated at arrow 48, the tape backing can be removed, the horizontal leg 14 positioned against the shelf 36 (FIG. 7), and adhered to the shelf 36 by pressing down on the spine 12 as indicated by the arrow 50.

Figure 10:
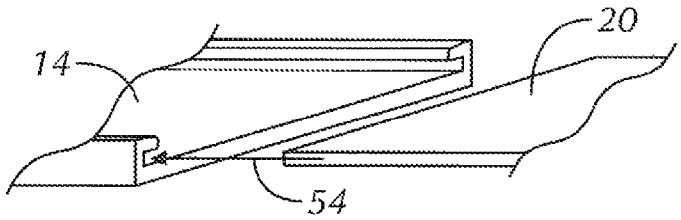
FIG. 10 is a detail view as seen in the block 10-10 in FIG. 8.

Returning to a discussion of the various orientations of the upper holder 28, because of the square configuration of the sliding member 44, a person can orient the upper holder 28 as shown in FIGS. 1, 2, 8, and 9 and slide it down along the vertical leg 16 of the spine 12 as indicated by the arrow 52. The lower holder 20 can also be slid into the horizontal leg 14 as shown by the arrow 54 in FIGS. 8 and 10. As shown best in FIG. 9, the sliding member 44 of the upper holder 28 is received in the U-shaped channels formed by the L-shaped flanges 18 of the vertical leg 16, with the stalk 30 riding along the outer surfaces of the flanges 18.

Figure 11:
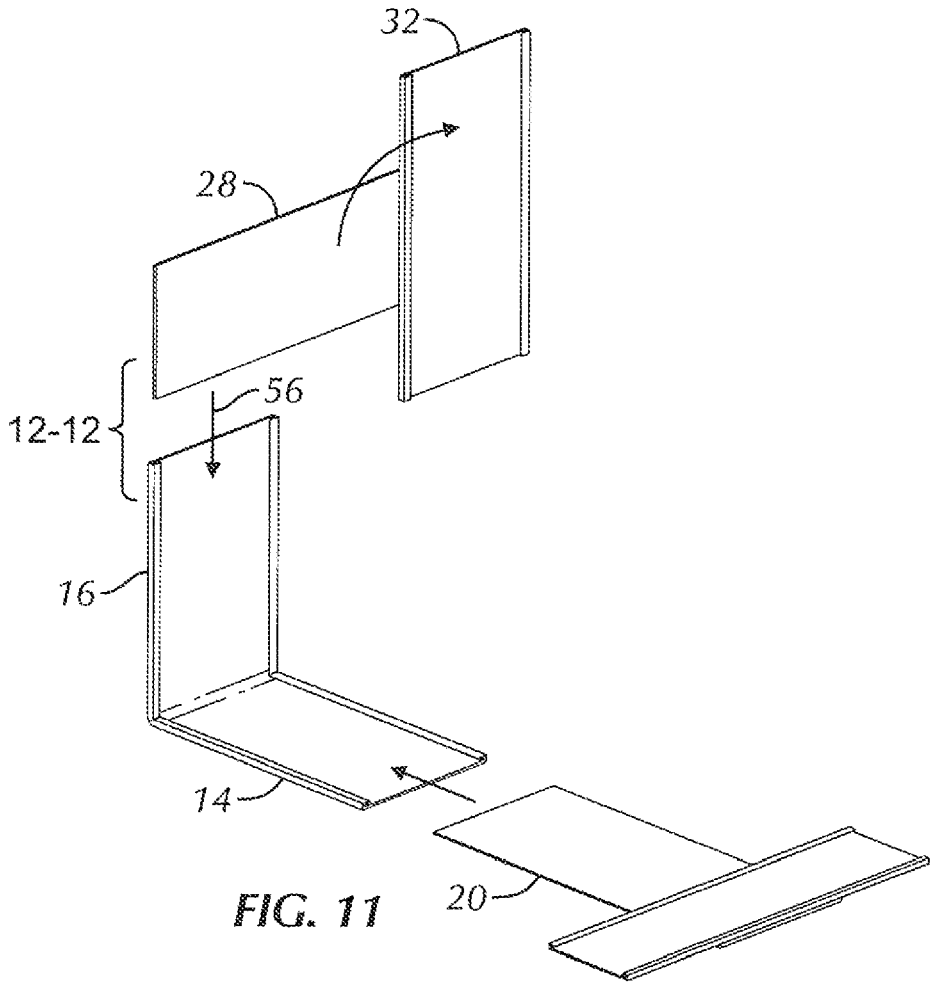
FIG. 11 is an exploded perspective view of the spine with upper and lower holders, with the upper holder in a "left side" orientation.
Figure 12:
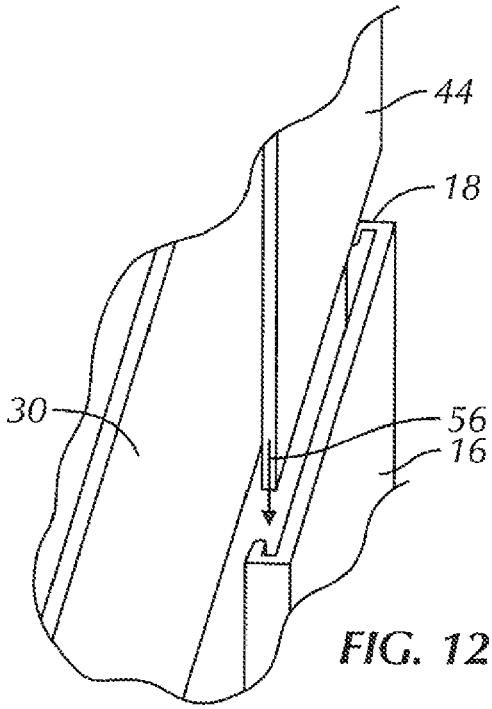
FIG. 12 is a detail view as seen in the block 12-12 in FIG. 11.

Alternatively, as shown in FIGS. 11 and 12 the upper holder 28 can be disengaged from the spine 12 and rotated ninety degrees with respect to the orientation shown in FIGS. 1, 2, 8, and 9, with the upper substrate-holding cross-member 32 entirely on the right of the vertical leg 16, long edges perpendicular to the horizontal leg 14 as shown. The stalk 30 with sliding member 44 is then slid down as indicated by the arrow 56, with the sliding member 44 trapped in the U-shaped channels of the vertical leg 16 of the spine 12 as described above. It will readily be appreciated that owing to the above-described interference fit, the upper holder 28 can be slid as far or as little as desired in the direction of the arrow 56, to account for CE device configuration and POS constraints.

Figure 13:
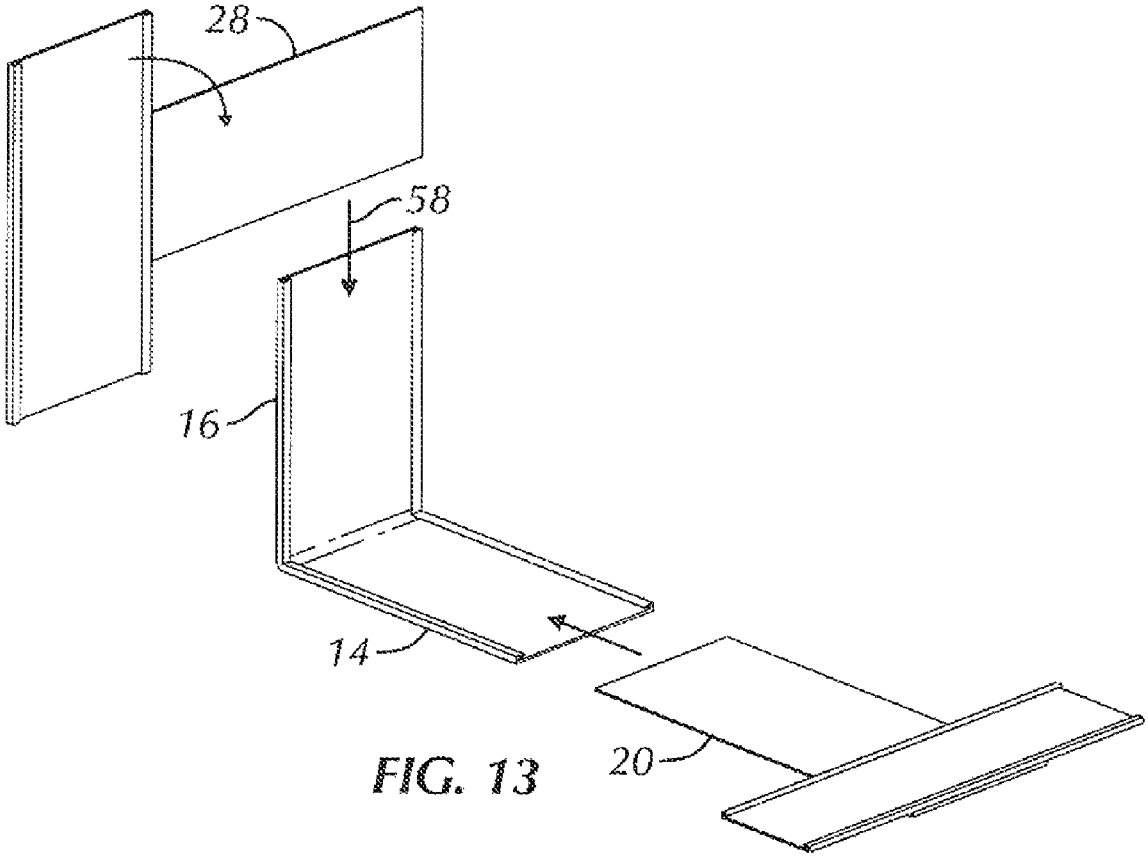
FIG. 13 is an exploded perspective view of the spine with upper and lower holders, with the upper holder in a "right side" orientation.
Figure 14:
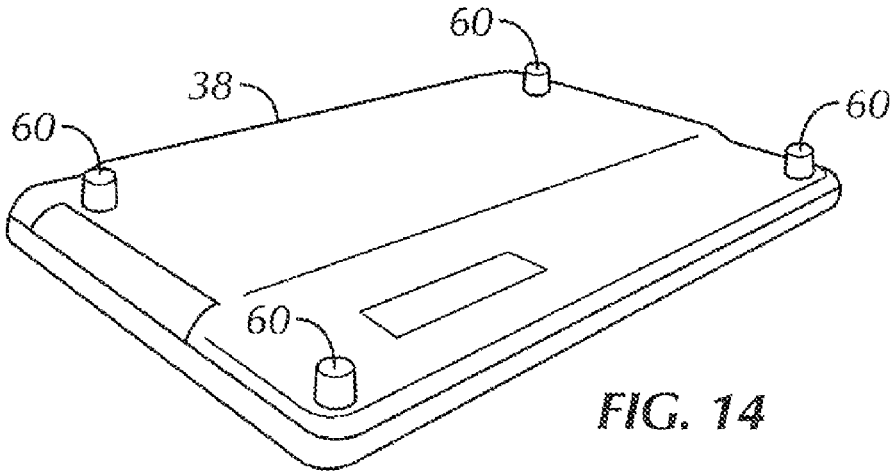
FIG. 14 is a bottom view of an example CE device with the risers attached for resting on the horizontal leg of the spine.

Yet again, as shown in FIG. 13 the upper holder 28 can be disengaged from the spine 12 and rotated ninety degrees with respect to the orientation shown in FIGS. 1, 2, 8, and 9, with the upper substrate-holding cross-member 32 entirely on the right of the vertical leg 16, long edges perpendicular to the horizontal leg 14 as shown. The stalk 30 with sliding member 44 is then slid down as indicated by the arrow 58, with the sliding member 44 trapped in the U-shaped channels of the vertical leg 16 of the spine 12 as described above. It will readily be appreciated that owing to the above-described interference fit, the upper holder 28 can be slid as far or as little as desired in the direction of the arrow 56, to account for CE device configuration and POS constraints.

In the case in which it is desirable to raise the CE device 38 above the horizontal leg 14 of the spine 12 and indeed to rest the CE device 38 on the shelf 36, as opposed to the spine 12, to facilitate sliding of the lower holder 20 relative to the spine 12, knob-like risers 60 may be adhered to the bottom of the CE device 38 using, e.g., double-backed tape. The risers 60, spine 12, and upper and lower holders 28, 20 may be provided as a kit of parts to a retail outlet.

While the particular CONFIGURABLE COMPUTER DISPLAY STAND BEARING SIGNAGE WITH A USER-SELECTED ONE OF MULTIPLE ORIENTATIONS TO PHYSICALLY CONFORM TO POINT OF SALE PHYSICAL CONSTRAINTS is herein shown and described in detail, it is to be understood that the subject matter which is encompassed by the present invention is limited only by the claims.

What is claimed is:

1. Display assembly comprising:

an L-shaped spine including a flat rectangular horizontal leg and attached to an end of or made integrally with the horizontal leg a flat rectangular vertical leg perpendicular to the horizontal leg, a respective L-shaped flange bordering a respective long edge of each leg to form, with the respective leg, a respective U-shaped channel;

a flat T-shaped lower advertising substrate holder slidably engageable with the U-shaped channels of the horizontal leg, the lower holder including a rectangular stalk the edges of which are slidably received in the U-shaped channels of the horizontal leg and perpendicular to the stalk a rectangular substrate-holding cross-member, L-shaped flanges bordering long edges of the cross-member for forming, with the cross-member, U-shaped channels configured for slidably receiving a flat rectangular printed substrate, an interference fit being established between the lower holder and the horizontal leg such that the lower holder can be slid as far or as little relative to the horizontal leg as desired to account for point of sale (POS) constraints;

a flat T-shaped upper advertising substrate holder including a rear member that can be slid into the U-shaped channels of the vertical leg of the spine in a user-desired one of multiple orientations, the upper holder including a rectangular stalk and perpendicular to the stalk a rectangular substrate-holding cross-member, L-shaped flanges bordering long edges of the cross-member for forming, with the cross-member, U-shaped channels that slidably receive a flat rectangular printed substrate, an interference fit being established between the upper holder and vertical leg such that the upper holder can be slid as far or as little relative to the vertical leg as desired to account for POS constraints, wherein the cross-member of the upper holder is orientable with its long edges parallel to the horizontal and then engageable with the vertical leg with its long edges parallel to the horizontal, the cross-member of the upper holder also being orientable with the long edges of the cross-member perpendicular to the horizontal on a user-selected side of the horizontal leg of the spine and then engageable with the vertical leg with its long edges perpendicular to the horizontal.

2. The assembly of claim 1, comprising a CE device juxtaposed with the horizontal leg, an upper flat, rectangular printed advertising substrate supported by the upper holder, and a lower flat, rectangular printed advertising substrate supported by the lower holder.

3. The assembly of claim 1, wherein the rear member is established at least in part by a square sliding member.

4. The assembly of claim 3, wherein edges of the stalk of the upper holder extend slightly beyond edges of the square sliding member.

5. The assembly of claim 3, wherein air-filled gaps are established along all four edges of the sliding member between the stalk and a square surface of the sliding member facing the stalk, such that the upper holder can be slidably engaged with the vertical leg of the spine by sliding the stalk of the upper holder against the vertical leg with the sliding member slidably disposed in the channels formed by L-shaped flanges of the vertical leg of the spine and with lips of the L-shaped flanges of the vertical leg trapping the sliding member in the U-shaped channel, with the front surface of the stalk overlapping the front surfaces of the lips.

6. A display stand for a laptop computer comprising:

an L-shaped spine;

a T-shaped upper advertising substrate holder slidably engaged with a vertical leg of the spine in a user-determined one of multiple orientations, a first orientation being a cross-member of the upper holder oriented horizontal to the ground, a second orientation being the cross-member of the upper holder oriented vertical to the ground, an upper advertising substrate being supported by the upper holder;

a T-shaped lower advertising substrate holder slidably engaged with a horizontal leg of the spine to support a lower advertising substrate in a horizontal orientation, wherein the legs of the spine are flat and rectangular and the vertical leg is perpendicular to the horizontal leg, a respective L-shaped flange bordering a respective long edge of each leg to form, with the respective leg, a respective U-shaped channel, wherein the lower advertising substrate holder is slidably engageable with the U-shaped channels of the horizontal leg, the lower holder including a rectangular stalk the edges of which are slidably received in the U-shaped channels of the horizontal leg and perpendicular to the stalk a rectangular substrate-holding cross-member, L-shaped flanges bordering long edges of the cross-member for forming, with the cross-member, U-shaped channels configured for slidably receiving a flat rectangular printed substrate, an interference fit being established between the lower holder and the horizontal leg such that the lower holder can be slid as far or as little relative to the horizontal leg as desired to account for point of sale (POS) constraints, wherein the upper substrate holder includes a rear member that can be slid into the U-shaped channels of the vertical leg of the spine in a user-desired one of multiple orientations, the upper holder including a rectangular stalk and perpendicular to the stalk a rectangular substrate-holding cross-member, L-shaped flanges bordering long edges of the cross-member for forming, with the cross-member, U-shaped channels that slidably receive a flat rectangular printed substrate, an interference fit being established between the upper holder and vertical leg such that the upper holder can be slid as far or as little relative to the vertical leg as desired to account for POS constraints, wherein the cross-member of the upper holder is orientable with its long edges parallel to the horizontal and then engageable with the vertical leg with its long edges parallel to the horizontal, the cross-member of the upper holder also being orientable with the long edges of the cross-member perpendicular to the horizontal on a user-selected side of the horizontal leg of the spine and then engageable with the vertical leg with its long edges perpendicular to the horizontal.

7. The stand of claim 6, comprising a CE device juxtaposed with the horizontal leg, an upper flat, rectangular printed advertising substrate supported by the upper holder, and a lower flat, rectangular printed advertising substrate supported by the lower holder.

8. The stand of claim 6, wherein the rear member is established at least in part by a square sliding member.

9. The stand of claim 8, wherein edges of the stalk extend slightly beyond edges of the square sliding member.

10. The stand of claim 8, wherein air-filled gaps are established along all four edges of the sliding member between the stalk and a square surface of the sliding member facing the stalk, such that the upper holder can be slidably engaged with the vertical leg of the spine by sliding the stalk of the upper holder against the vertical leg with the sliding member slidably disposed in the channels formed by L-shaped flanges of the vertical leg of the spine and with lips of the L-shaped flanges of the vertical leg trapping the sliding member in the U-shaped channel, with the front surface of the stalk overlapping the front surfaces of the lips.

11. Method comprising:

engaging an upper substrate holder with a support with a variable orientation being established between the upper holder and support as desired to conform to physical constraints of a point of sale (POS);

juxtaposing the support with a consumer electronics (CE) device sought to be vended;

engaging a printed advertising substrate with the upper substrate holder to permit a prospective buyer of the CE device to view the substrate in combination with the CE device;

engaging a lower substrate holder with the support with a variable position being established between the lower holder and support, wherein the support is established by an L-shaped spine, the upper holder being T-shaped and being slidably engaged with a vertical leg of the spine in a user-determined one of multiple orientations, a first orientation being a cross-member of the upper holder oriented horizontal to the ground, a second orientation being the cross-member of the upper holder oriented vertical to the ground, an upper advertising substrate being supported by the upper holder, wherein the upper substrate holder includes a rear member that can be slid into U-shaped channels of the vertical leg of the spine in a user-desired one of multiple orientations, the upper holder including a rectangular stalk and perpendicular to the stalk a rectangular substrate-holding cross-member, L-shaped flanges bordering long edges of the cross-member for forming, with the cross-member, U-shaped channels that slidably receive a flat rectangular printed substrate, an interference fit being established between the upper holder and vertical leg such that the upper holder can be slid as far or as little relative to the vertical leg as desired to account for POS constraints.

12. The method of claim 11, wherein the cross-member of the upper holder is orientable with its long edges parallel to the horizontal and then engageable with the vertical leg with its long edges parallel to the horizontal, the cross-member of the upper holder also being orientable with the long edges of the cross-member perpendicular to the horizontal on a user-selected side of the horizontal leg of the spine and then engageable with the vertical leg with its long edges perpendicular to the horizontal.

13. The method of claim 12, wherein the rear member is established at least in part by a square sliding member, wherein air-filled gaps are established along all four edges of the sliding member between the stalk and a square surface of the sliding member facing the stalk, such that the upper holder can be slidably engaged with the vertical leg of the spine by sliding the stalk of the upper holder against the vertical leg with the sliding member slidably disposed in the channels formed by L-shaped flanges of the vertical leg of the spine and with lips of the L-shaped flanges of the vertical leg trapping the sliding member in the U-shaped channel, with the front surface of the stalk overlapping the front surfaces of the lips.

* * * * *